US006209438B1

(12) United States Patent
Mitchell et al.

(10) Patent No.: US 6,209,438 B1
(45) Date of Patent: Apr. 3, 2001

(54) INTERLOCK MECHANISM FOR A SLICER

(75) Inventors: Dan J. Mitchell, Franklin; Neal H. Blackburn, Springfield, both of OH (US)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 09/470,351

(22) Filed: Dec. 22, 1999

(51) Int. Cl.[7] ..... B26D 7/22
(52) U.S. Cl. ..... 83/729; 83/932; 83/707
(58) Field of Search ..... 83/932, 77, 729, 83/730, 719, 714, 717, 703, 707, 410.7, 410.8, 412

(56) References Cited

U.S. PATENT DOCUMENTS

| | | | |
|---|---|---|---|
| D. 269,347 | 6/1983 | Cantatore et al. | D7/383 |
| 1,518,474 | 12/1924 | Wile . | |
| 2,004,603 | 6/1935 | Folk | 146/102 |
| 2,010,944 | 8/1935 | Campbell | 146/102 |
| 2,086,759 | 7/1937 | Wood | 146/102 |
| 2,136,792 | 11/1938 | Folk | 146/102 |
| 2,402,519 | 6/1946 | Wood | 146/102 |
| 2,573,860 | 11/1951 | Meeker et al. | 146/102 |
| 2,744,554 | 5/1956 | King | 146/102 |
| 2,970,623 | 2/1961 | Lundell | 146/102 |
| 3,159,196 | 12/1964 | Engi | 146/102 |
| 3,704,736 | 12/1972 | Pratley | 83/397 |
| 3,927,588 | 12/1975 | Laderach | 83/15 |
| 3,972,256 | 8/1976 | Ross | 83/155 |
| 3,974,725 | 8/1976 | Boots | 83/100 |
| 4,070,941 | 1/1978 | Lorenz | 83/478 |
| 4,217,650 | 8/1980 | Kuchler | 364/567 |
| 4,246,818 | 1/1981 | McGraw, Jr. | 83/478 |
| 4,318,321 | 3/1982 | De Mattos | 83/71 |
| 4,379,416 | 4/1983 | Kuchler | 83/23 |
| 4,397,206 | 8/1983 | Czala | 83/399 |
| 4,541,319 | 9/1985 | Maurer et al. | 83/707 |
| 4,598,618 | 7/1986 | Kuchler | 83/77 |
| 4,598,620 | 7/1986 | Flammann | 83/399 |
| 4,612,836 * | 9/1986 | Henn et al. | 83/729 |
| 4,685,364 | 8/1987 | Scheflow et al. | 83/68 |
| 4,763,738 | 8/1988 | Kuchler | 177/80 |
| 4,813,316 | 3/1989 | Johnson et al. | 83/42 |
| 5,121,554 | 6/1992 | Havins | 33/640 |
| 5,241,885 | 9/1993 | Kuchler | 83/76.7 |
| 5,245,898 | 9/1993 | Somal et al. | 83/58 |
| 5,509,337 | 4/1996 | Norman et al. | 83/546 |
| 5,615,591 | 4/1997 | Scherch et al. | 83/399 |
| 5,687,626 | 11/1997 | Scherch et al. | 83/719 |
| 6,016,734 * | 1/2000 | Koch | 83/707 |

FOREIGN PATENT DOCUMENTS

| | | |
|---|---|---|
| 1196985 | 7/1965 | (DE) . |
| 2749652 | 5/1979 | (DE) . |
| 3201520A1 | 7/1983 | (DE) . |
| 2090122A | 7/1982 | (GB) . |

* cited by examiner

*Primary Examiner*—M. Rachuba
*Assistant Examiner*—Kim Ngoc Tran
(74) *Attorney, Agent, or Firm*—Thompson Hine & Flory LLP

(57) ABSTRACT

A slicer having an interlock mechanism, the slicer comprising a tray for receiving a food product to be sliced, the tray being movable along a slicing path and having a tray arm. The slicer further includes a blade for slicing the food product as the tray moves along the slicing path and a carriage having a locking arm for receiving the tray arm. The locking arm is movable between a release position wherein the tray arm can be placed into and removed from the locking arm, and a locking position wherein the tray arm cannot be placed into or removed from the locking arm. The slicer has a gauge plate adjuster for controlling the position of a gauge plate in the slicer, and the gauge plate adjuster has a recess formed therein. At least part of the locking arm is received in the recess of the gauge plate adjuster when the locking arm is in the release position.

24 Claims, 11 Drawing Sheets

INTERLOCK MECHANISM FOR A SLICER

TECHNICAL FIELD

The present invention is directed to a slicer having an interlock mechanism, and more particularly, to a slicer having an interlock mechanism that prevents the tray arm of the slicer from being uncoupled from the slicer when the slicer is not in the desired configuration.

BACKGROUND OF THE INVENTION

Commercial food product slicers are widely utilized as rapid and effective means for slicing meat, cheese, vegetables and other food products. The slicers commonly include a rotatable, disc-like blade, and a reciprocating tray that brings the food product into contact with the rotating blade to cut a slice from the food product. Most slicers also include a movable gauge plate that adjusts the position of the food product relative the blade, which varies the thickness of the slices cut off of the food product. The gauge plate typically has a "closed" position, wherein the gauge plate is slightly raised relative the blade such that the food product cannot be cut by the blade.

It is often desired to remove the tray from the slicer body to clean food, fat, or other debris off of the tray. Once the tray is removed from the slicer, it is typically carried to a sink for rinsing and cleaning. Many slicers use an interlock mechanism to ensure that the tray can only be removed from the slicer when the gauge plate is in its closed position, or when the tray is in its home position. However, existing interlock mechanisms may require a large number of parts, and many of the parts must be precision machined. Furthermore, in existing interlock mechanisms a relatively high number of components of the interlock mechanism may be located on the tray instead of being located on the body of the slicer, which makes cleaning of the tray more difficult. Accordingly, there is a need for an interlock mechanism for a slicer that has a relatively low part count and which minimizes the number of components located on the tray.

SUMMARY OF THE INVENTION

The present invention is slicer having an interlock mechanism which has a relatively low part count and minimizes the number of parts of the interlock mechanism located on the tray. Because the number of parts of the interlock mechanism located on the tray is minimized, most of the components of the interlock mechanism remain protected on the body of the slicer, and the tray is easier to clean.

In a preferred embodiment, the present invention is a slicer having an interlock mechanism, the slicer comprising a tray for receiving a food product to be sliced, the tray being movable along a slicing path and having a tray arm. The slicer further includes a blade for slicing the food product as the tray moves along the slicing path and a carriage having a locking arm for receiving the tray arm. The locking arm is movable between a release position wherein the tray arm can be placed into and removed from the locking arm, and a locking position wherein the tray arm cannot be placed into or removed from the locking arm. The slicer has a gauge plate adjuster for controlling the position of a gauge plate in the slicer, and the gauge plate adjuster has a recess formed therein. At least part of the locking arm is received in the recess of the gauge plate adjuster when the locking arm is in the release position.

Other objects and advantages of the present invention will be apparent from the following description and the accompanying drawings.

DETAILED DESCRIPTION

Figure 1:
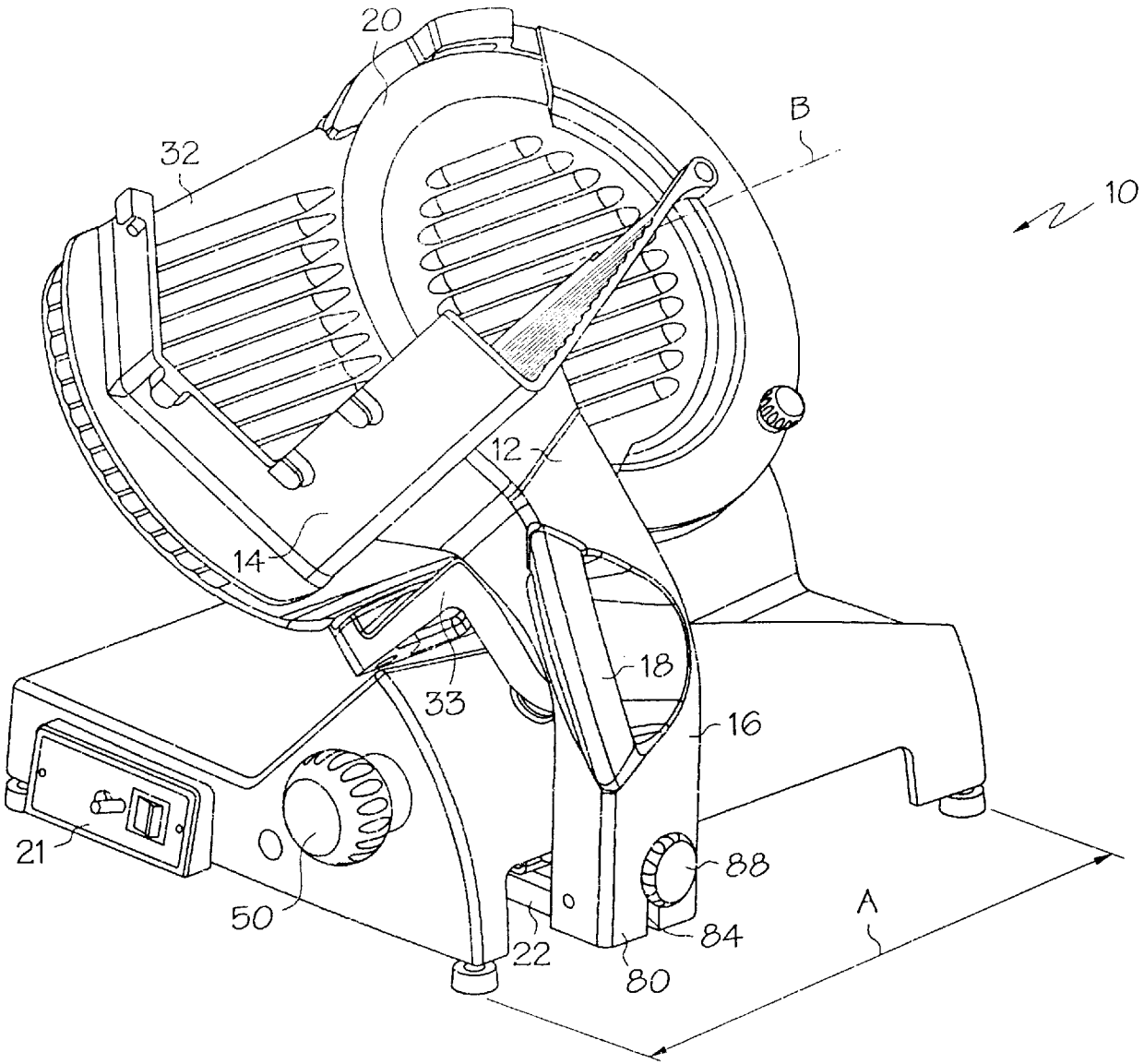
FIG. 1 is a perspective view of a slicer incorporating a preferred embodiment of the interlock of the present invention, with the slicer arm being located in the home position.

As shown in FIG. 1, the present invention is an interlock mechanism for use in a slicer 10. The slicer 10 includes a tray 12 having a "V"-shaped plate 14 to receive the food product to be sliced. The tray 12 includes a tray arm 16, and the tray 12 is typically powered along the slicing path A by a motor (not shown). Alternately, a user may grip the handle 18 and manually move the tray 16 along the slicing path A. The slicer 10 also includes a rotating, circular blade 20 having a central axis B. As the tray 12 reciprocates along the slicing path A, the tray 12 brings the food product into contact with the blade 20 to cut a slice off of the food product.

The tray arm 16 is coupled to a carriage 22 that extends below the body of the slicer 10 and includes an upwardly-extending end plate 24 (See FIGS. 3–4). The carriage 22 can be driven along the slicing path A and thereby drives the tray arm 16 along the slicing path A. During operation of the slicer, the tray 12 and carriage 22 preferably begin a slicing stroke at the home position, shown in FIG. 1. When in the home position, the tray 12 and carriage 22 are located closest to the operator and controls 21, and furthest from the blade 20. The tray 12 is shown in a non-home position in FIG. 2, where the tray 12 has completed a partial slicing stroke.

The slicer 10 includes a gauge plate 32 that is movable to adjust the thickness of the slice cut by the blade 20. The gauge plate 32 supports the food product as the tray 12 is passed across the blade 20, and the gauge plate 32 is movable along a line that is parallel to the central axis B of the blade 20. The closer the gauge plate 32 is located to the plane of the blade 20, the thinner the slice cut by the slicer 10. Thus, adjusting the position of the gauge plate 32 also adjusts the thickness of the slice. The gauge plate 32 may also be moved to a fully closed position wherein the gauge plate is flush with, or extends beyond, the blade 20 to substantially cover and protect the blade 20.

Figure 10:
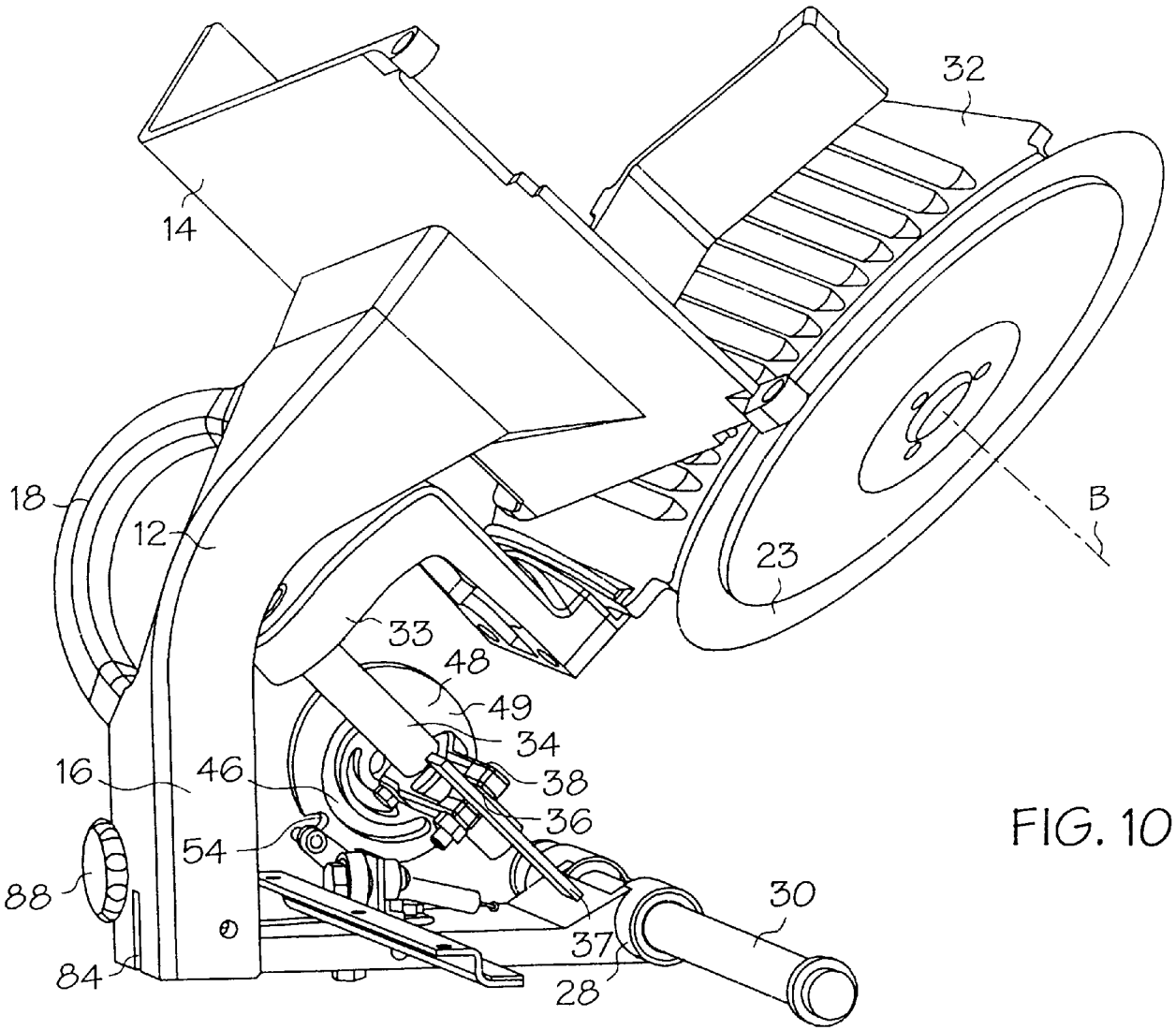
FIG. 10 is a perspective view showing various internal mechanisms of the slicer of FIG. 1.

As shown in FIG. 10, the gauge plate 32 is mounted onto a yoke 33. The yoke 33 is, in turn, coupled to a connecting rod 34 that extends generally parallel to the central axis B of the blade 20 and blade support 23. The connecting rod 34 is coupled to a transverse bar 38 that has an open end 36 and coupling pin 40 (FIG. 11) that is received in a spiral groove 46 of a gage plate cam 48. The open end 36 of the connecting rod slidingly receives a guide rail 37 therethrough. The guide rail 37 extends generally parallel to the central axis of the connecting rod 34.

Figure 11:
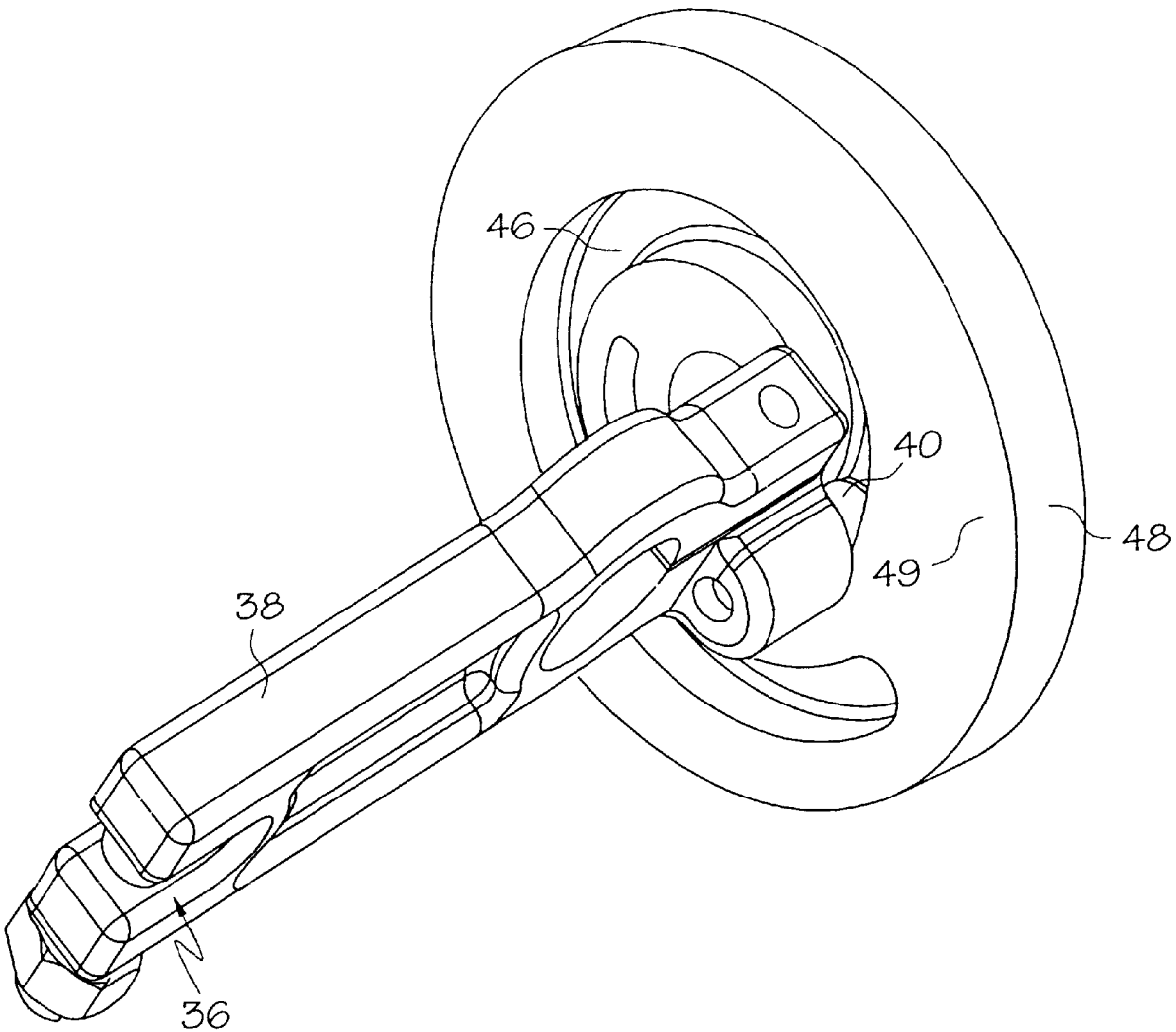
FIG. 11 is a detail perspective view showing the traverse bar and the gauge plate cam.

The slicer 10 includes a generally "wheel" shaped gauge plate cam 48 having a spiral groove 46 formed on a first side 49 of the cam, and a notch 47 (FIG. 4) on the second side 51 of the cam 48. The coupling pin 40 of the transverse bar 38 is received in the spiral groove 46 of the cam 48, as shown in FIG. 11. The gauge plate cam 48 is coupled to a gauge plate knob 50 (FIG. 1) such that manual rotation of the gauge plate knob 50 causes rotation of the gauge plate cam 48.

When a user desires to adjust the position of the gauge plate 32 to vary the thickness of a slice cut by the slicer 10, the user manually rotates the gauge plate knob 50 which rotates the gauge plate cam 48. As the gauge plate cam 48 rotates, the coupling pin 40 slides within the spiral groove 46, which urges the coupling pin 40 and the transverse bar 38 either closer to, or further away from, the slide rod 30 along the direction of the axis B. This in turn moves the connecting rod 34 along its central axis, and adjusts the position of the yoke 33 and gauge plate 32 along the axis B (FIG. 10). Thus, rotation of the gauge plate knob 50 and gauge plate cam 48 causes the gauge plate 32 to move closer to, or further away from, the blade 20. It should be understood that this mechanism for varying the position of the gauge plate 32 is merely one of many mechanisms that may be used to adjust the gauge plate, and nearly any mechanism for adjusting the gauge plate 32 may be used with the interlock of the present invention without departing from the scope of the invention.

Figure 3A:
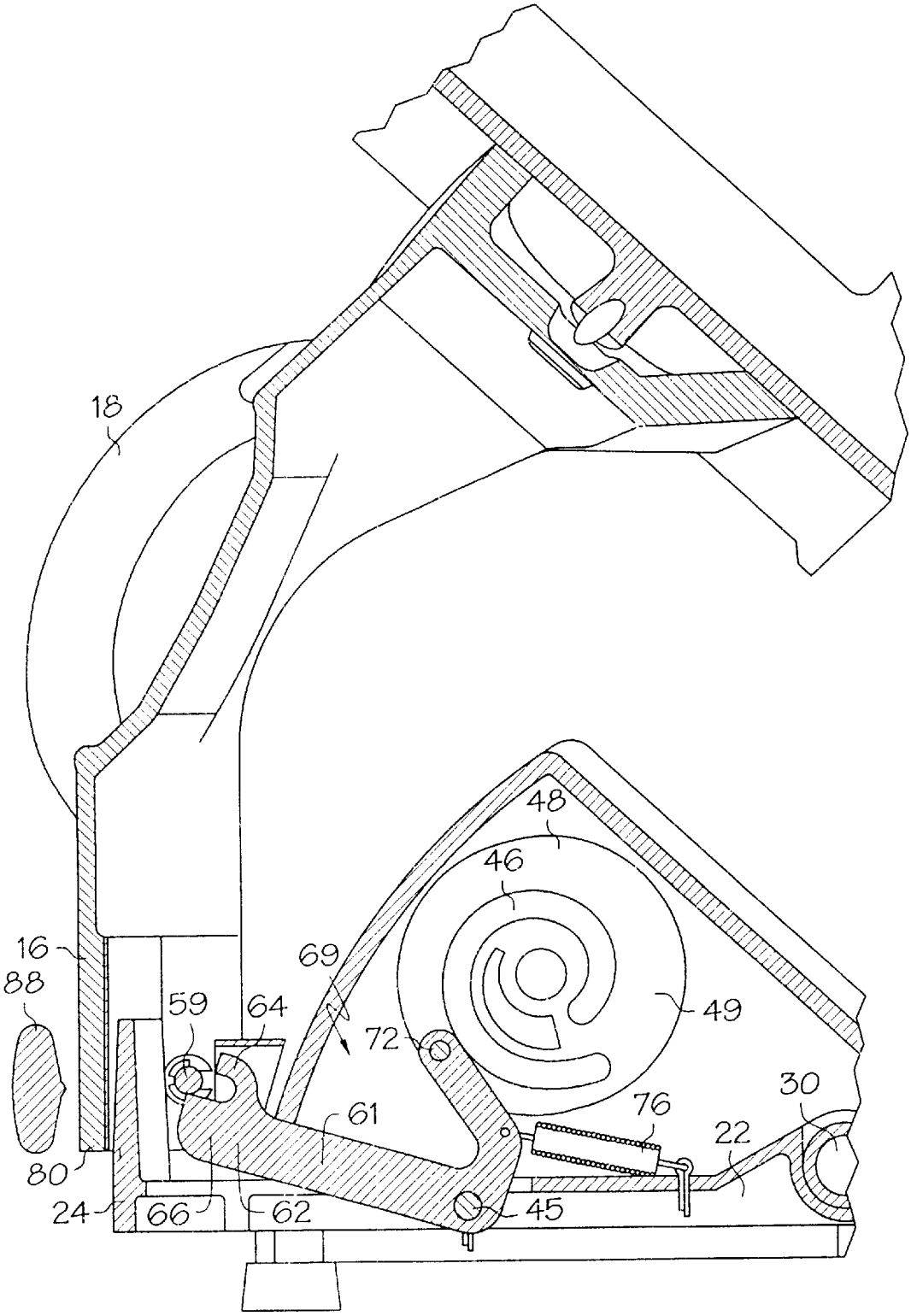
FIG. 3A is a side, cross section view of the slicer of FIG. 1, locking arm in its release position.
Figure 3B:
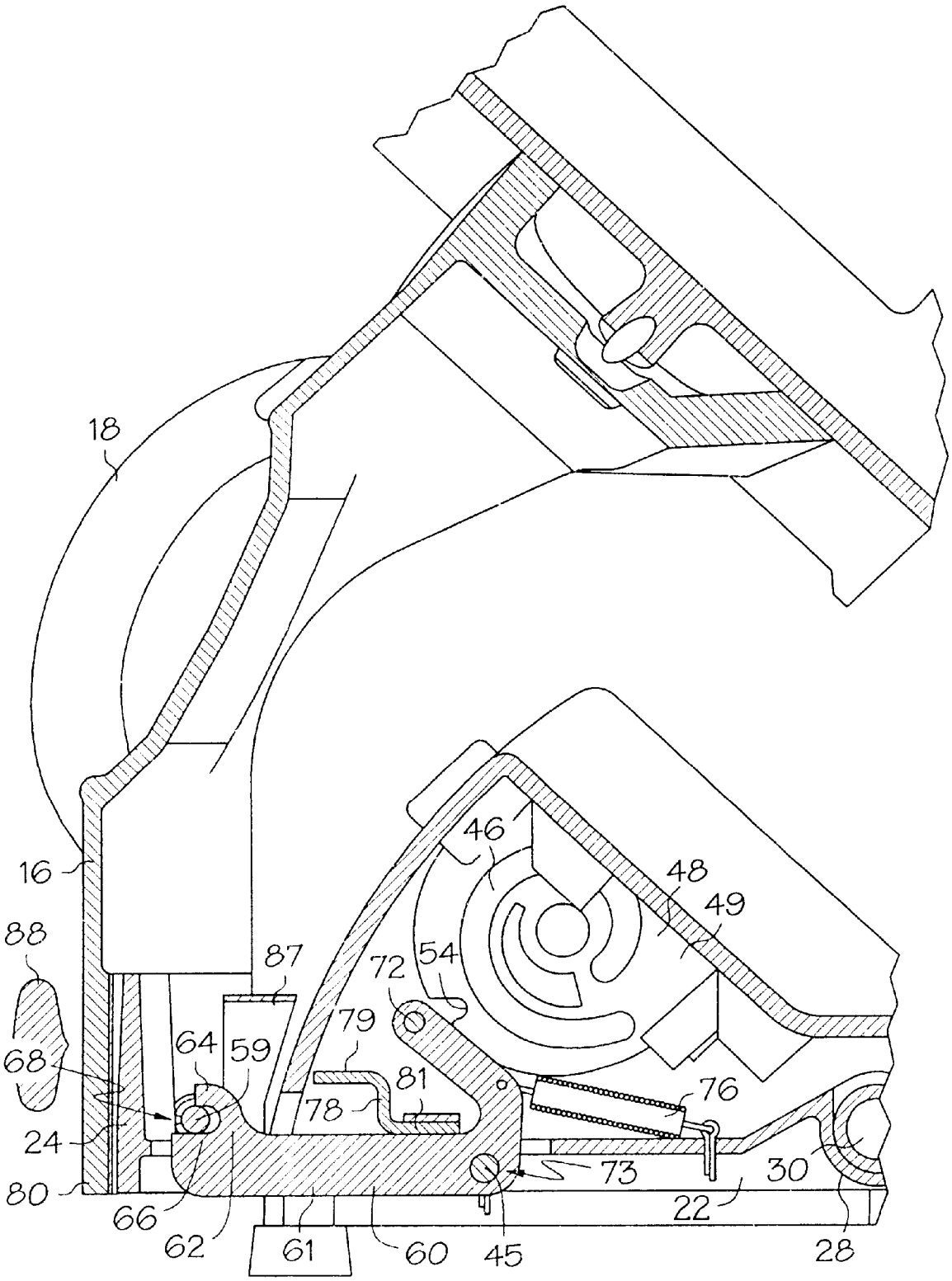
FIG. 3B is a side, cross section view of the slicer of FIG. 3A, with the locking arm in its locking position and the tray arm retained in the locking arm.
Figure 4:
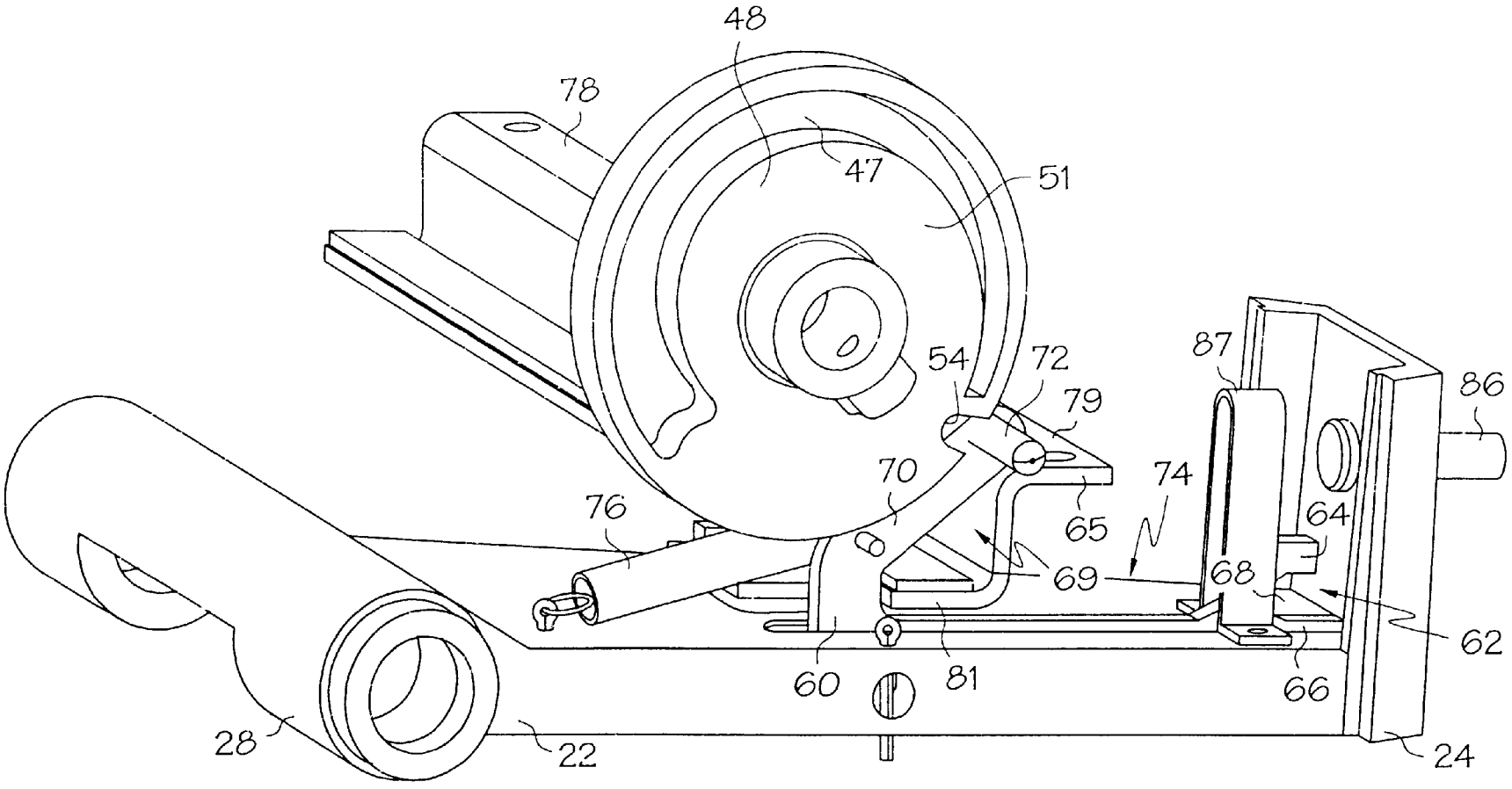
FIG. 4 is a perspective view of the carriage, gauge plate cam and hold-down bar of the slicer of FIG. 1, with the locking arm in its locking position.
Figure 5:
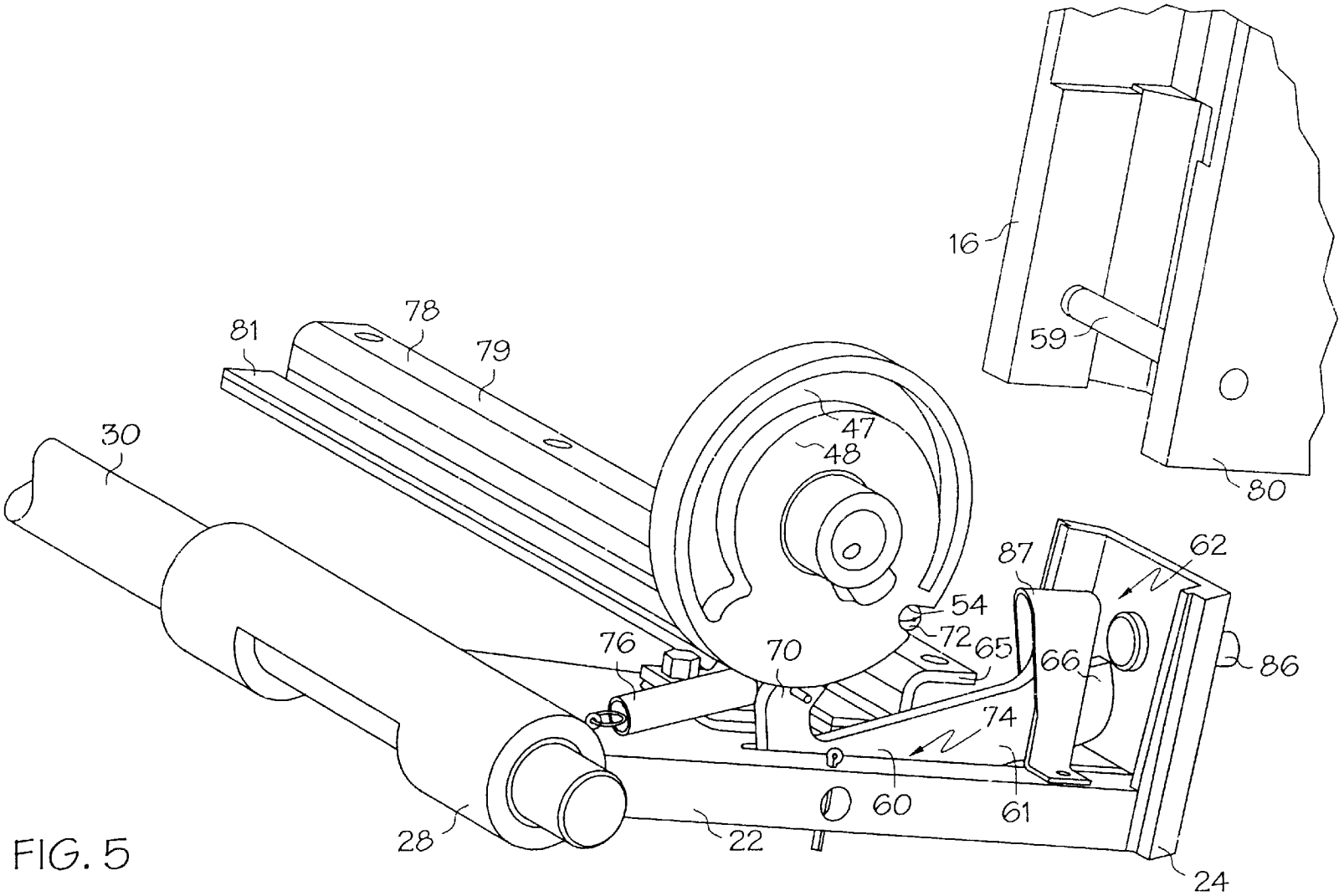
FIG. 5 is a perspective view of the carriage, gauge plate cam and hold-down bar of FIG. 4, along with part of the slicer arm, with the locking arm in its release position.

The mechanism for attaching the carriage 22 to the tray arm 16 is shown in greater detail in FIGS. 3–5. The lower end of the tray arm 16 is generally "U"-shaped in cross section (FIG. 5), and includes an outer body 80 and a cross bar 59. The carriage 22 includes a bushing 28 that receives a guide rod 30 to guide the reciprocation of the carriage 22. The carriage 22 includes a locking arm 60 for coupling the tray arm 16 to the carriage 22, and the locking arm is pivotably coupled to the carriage 22 by pin 45 (FIG. 3A).

Figure 8:
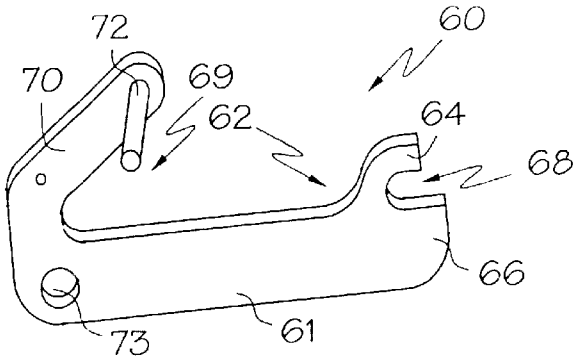
FIG. 8 is a perspective view of the locking arm.

The locking arm 60 is generally "U"-shaped in side view as shown in FIG. 8. The locking arm 60 includes a lower portion 61 that tenninates in an open end 62. The open end 62 includes an upper flange 64, a lower flange 66, and a notch 68 located between the upper 64 and lower 66 flanges. The locking arm 60 also includes an upper portion 70 that includes a transverse pin 72. The locking arm 60 has a lower hole 73, and the arm 60 is pivotably attached to the carriage 22 by a pin 45 received through the lower hole 73 (see FIG. 3B). The locking arm 60 is received in a groove 74 formed in the carriage (FIG. 4), and the locking arm 60 is pivotable about the pin 45 between a locking position (FIG. 4) and a release position (FIG. 5). A spring 76 extends between the locking arm 60 and the carriage 22 to bias the locking arm 60 in the release position. When the locking arm 60 is in its release position, the tray arm 16 may be placed into, and removed from, the locking arm 60. Also, when the locking arm is in its release position, the transverse pin 72 of the locking arm 60 is received into the groove 54 of the gauge plate cam 48, which prevents any rotation of the gauge plate cam 48. In this manner, when the locking arm 60 is in its release position, a user is blocked from rotating the gauge plate cam 48, which blocks the user from adjusting the position of the gauge plate 32.

In order to attach the tray aim 16 to the carriage 22, the tray arm 16 is positioned over the upstanding end wall 24 of the carriage 22, as shown in FIG. 5. The locking arm 60 is automatically located in its release position as biased by the spring 76. The tray arm 16 is lowered over the carriage 22 such that the outer body 80 of the tray arm 16 slides around the upstanding end wall 24 of the carriage 22. The cross bar 59 of the tray arm is shaped and located to be received in the notch 68 of the open end 62 of the locking arm 60 (FIG. 8). As the tray arm 16 is lowered, the cross bar 59 is received in the notch 68 of the locking arm 60 and the cross bar 59 engages the lower flange 66 of the locking arm 60. The cross bar 59 then urges the locking arm 60 to pivot about the pin 45 to its locking position. FIG. 3B illustrates the locking arm 60 in its locking position with the cross bar 59 of the tray arm 16 received in the notch 68 of the locking arm.

As the locking arm 60 is moved into the locking position, the transverse pin 72 of the locking arm 60 is pulled out of the notch 54 in the gauge plate cam 48, as can be seen in FIG. 3B. Thus, once the locking arm 60 is in the locking position, the gauge plate cam 48 is free to rotate, and the user can adjust the position of the gauge plate 32.

Figure 2:
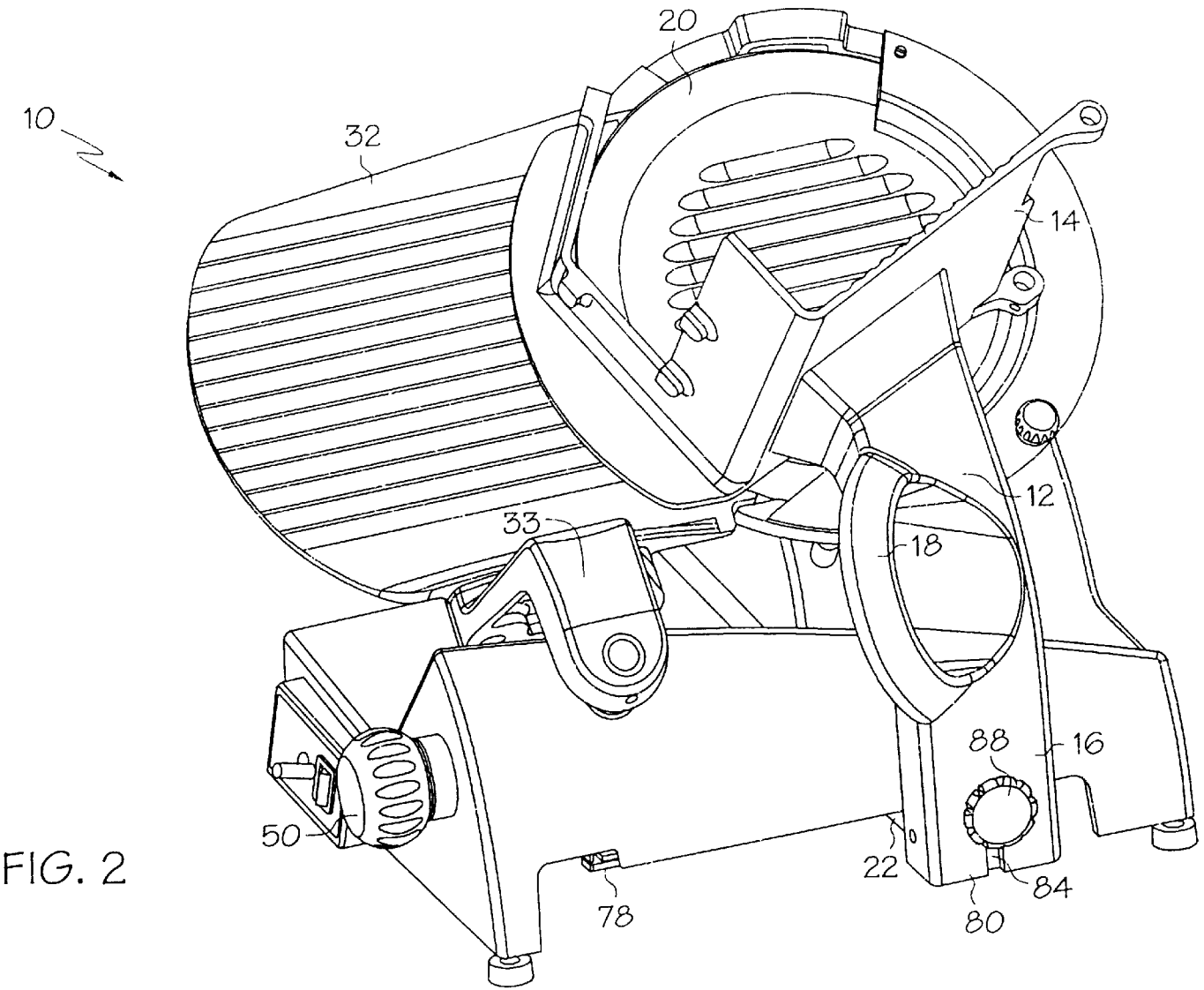
FIG. 2 is a perspective view of the slicer of FIG. 1, with the slicer arm in a non-home position.

The tray arm 16 also includes a vertically-extending slot 84 on its outer body 80 (See FIGS. 1–2). The slot 84 must be aligned with a threaded post or bolt 86 (FIG. 4) that extends forwardly from the upstanding end 24 wall of the carriage 22 when the tray arm 16 is lowered over the upstanding end wall 24. A nut 88 is threaded onto the threaded post 86, and spaced away from the upstanding end wall 29 to enable the tray arm 16 to be received between the nut 88 and the upstanding end wall 24. Once the tray arm 16 is mounted onto the carriage 22 and the locking arm 60 is moved to its locking position, the nut 88 may be tightened down to engage the outer body 80 and lock the tray 12 to the carriage 22.

Once the tray arm 16 is received in the locking arm 60 and the locking arm 60 is moved to its locking position, the slicer 10 may be moved out of its home position, and operated such that the tray 12 and carriage 22 reciprocate along the slicing path A. The slicer includes a retaining bar or track 78 that extends along the majority of the slicing path A, and the retaining bar 78 includes an upper portion 79 and a lower portion 81. The carriage 22 includes a roller 83 (FIG. 9) that rolls on top of the lower portion 81 to help guide the reciprocation of the carriage 22 along the slicing path A, and the roller 83 is coupled to the carriage 22 by a bracket 85.

Figure 7:
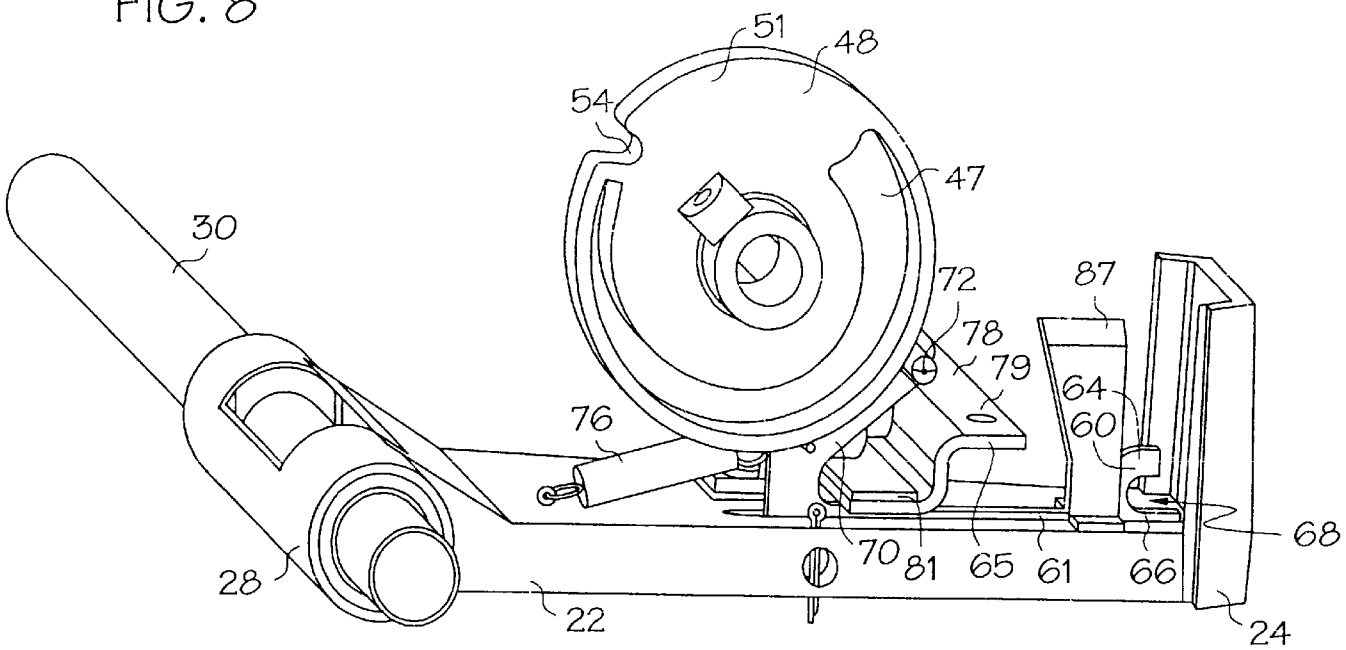
FIG. 7 is a perspective view of the carriage, gauge plate cam and hold-down bar of FIG. 6, with the carriage in a non-home position.
Figure 9:
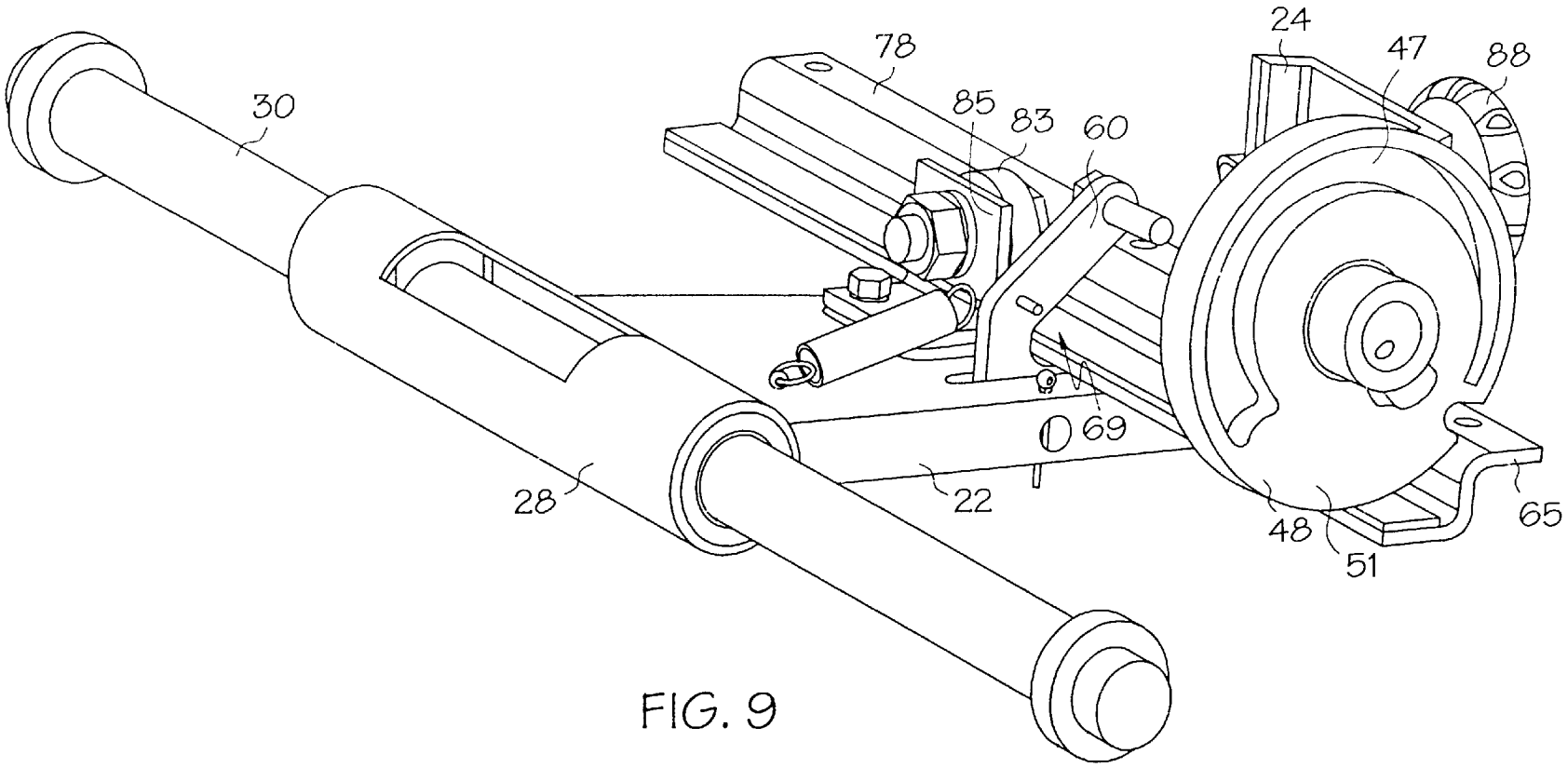
FIG. 9 is a perspective view of the carriage, gauge plate cam and hold-down bar of FIG. 6, with the carriage in a non-home position.

As shown in FIGS. 4–5, when the tray 12 is in the home position, the retaining bar 78 is not located above lower portion 61 of the locking arm 60. However, as shown in FIGS. 7 and 9, when the tray 16 is in a non-home position, the retaining bar 78 is located immediately above the lower portion 61 of the locking arm 60. FIG. 7 illustrates the position of the carriage 22 when the carriage has just moved from the home position, and FIG. 9 illustrates the position of the carriage 22 when the carriage has completed about half of a slicing stroke. In these non-home positions, the retaining bar 78 is received in a central gap 69 of the locking arm 60.

Thus, when the tray 16 is in a non-home position, the retaining bar 78 blocks the locking arm 60 from moving to its release position. If the tray 12 were to be attempted to be lifted off of the carriage 22 when the tray 12 is not in the home position, the cross bar 59 of the tray arm 16 would engage the top flange 64 of the locking arm and attempt to pivot the locking arm 60 to its release position. However, the lower portion 81 of the retaining bar 78 would block the locking arm 60 from pivoting, and thereby block the locking arm 60 from moving to its release position. Thus when the locking arm 60 is in its locking position and the tray 12 is in a non-home position, the tray arm 16 is locked into place in the locking arm 60 and cannot be removed from or placed into the locking arm 60.

During normal operating conditions, the carriage 22 and tray 12 reciprocate along the slicing path A to cut slices off of the food product. The gauge plate knob 50 may be adjusted to vary the thickness of the slices. The locking arm 60 retains the cross bar 59 of the tray arm 16 in the notch 68 of the locking arm, and the locking ann is maintained in its locking position by the retaining bar 78. However, the tray 12 and tray arm 16 must be periodically removed from the slicer in order to clean or service the tray arm 16. The interlock mechanism of the present invention prevents the tray 12 from being removed from the slicer 10 except when certain conditions are met.

Figure 6:
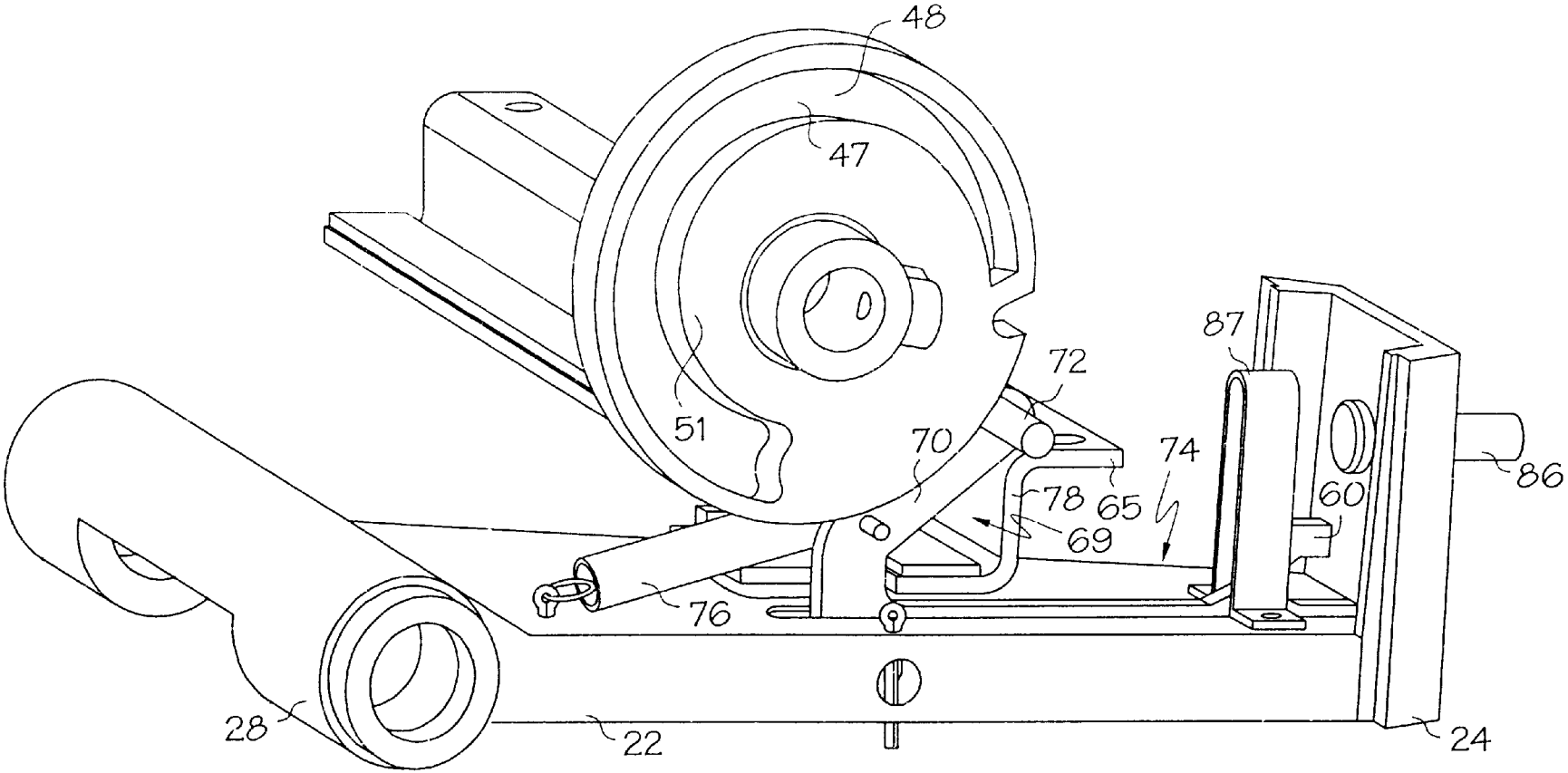
FIG. 6 is a perspective view of the carriage, gauge plate cam and hold-down bar of FIG. 4, with the gauge plate cam rotated from its position shown in FIG. 4.

In order to uncouple the tray 12 from the slicer 10, the tray 12 must first be moved to the home position. The tray 12 and carriage 22 are shown in the home position in FIG. 6. When the tray 12 is in its home position, the retaining bar 78 is not located above the locking arm 60, and therefore retaining bar 78 does not block the locking arm from moving to its release position. However, if locking arm 60 were attempted to be moved to its release position, the gauge plate cam 48 would block the locking arm from moving to its release position. More specifically, when the gauge plate cam 48 is in the configuration shown in FIG. 6, if locking arm 60 were attempted to be moved to its release position, the traverse pin 72 would engage the outer surface of the cam 48, which would block the locking arm 60 from pivoting to its release position.

In order for the locking arm 60 to pivot to its release position, the transverse pin 72 must be aligned with the notch 54 in the gauge plate cam 48. In order to align the notch 54 with the transverse pin 72, the gauge plate cam 48 is rotated by the knob 50 until the gauge plate cam 48 is in the position shown in FIG. 4. When the slicer is in this configuration, the traverse pin 72 can be received in the notch 54, which enables the locking arm 60 to move to its release position, as shown in FIG. 5. Once the locking arm 60 is in its release position, the tray arm 16 may be uncoupled from the carriage 22. The gauge plate cam 48 is preferably calibrated such that the gauge plate 32 is located in its fully closed position when the notch 54 of the gauge plate cam 48 is aligned with the traverse pin 72 of the locking arm 60. This ensures that the blade 20 is somewhat protected by the gauge plate 32 before the tray arm 16 can be removed.

Accordingly, the interlock mechanism of the present invention ensures that two conditions must be met before the tray 12 can be uncoupled from the carriage 22: (1) the tray 12 and carriage 22 must be located in their home position; and (2) the gauge plate 32 must be located in its fully closed position. Once both these requirements are met the nut 88 can be loosened and moved away from the tray arm 16, and the tray arm may then be lifted vertically off of the carriage 22 (FIG. 5). When the tray 12 is lifted off the carriage 22, the locking arm 60 is moved to its release position as biased by the spring 76, and remains in that position until the tray 12 is replaced in the locking arm 60.

The tray 12 may then be carried to a sink for cleaning or maintenance. The only component of the interlock mechanism of the present invention located on the tray 12 is the cross bar 59. In this manner, the number of parts of the interlock mechanism on the tray 12 is minimized, which minimizes the exposure of the parts of the interlock mechanism to water and detergents when the tray 12 is washed. Furthermore, the cross bar 59 is protected on three sides by the outer body 80, which protects the retaining bar from external forces.

When the tray 12 is uncoupled from the carriage 22, the locking arm 60 is in its position shown in FIG. 5. When in this position, the transverse pin 72 of the locking arm 60 is received in the notch 54 of the gauge plate cam 48. Thus, when the tray arm 16 is uncoupled from the carriage 22 the gauge plate cannot be adjusted. Furthermore, the locking arm 60 prevent the carriage 22 from moving away from the home position when the tray 12 is uncoupled from the carriage 22. If the carriage 22 were attempted to be moved along the slicing path A, the locking arm 60 would engage the end surface 65 of the retaining bar 78, which would block the attempted movement of the carriage along the slicing path. A cover 87 is located over the locking arm to prevent inadvertent movement of the locking arm to the release position when the tray 12 is removed.

After the tray 12 is cleaned or serviced, it may be coupled to the carriage 22. In order to attach the tray 12 to the carriage 22, the tray arm 16 is positioned over the upstanding end wall 24 of the carriage 22, as shown in FIG. 5. The tray arm 16 is lowered over the carriage 22 such that the outer body 80 of the tray arm 16 slides around the upstanding end wall 24 of the carriage 22. The cross bar 59 of the tray arm is received in the notch 68 of the open end 62 of the locking arm 60. As the tray arm 16 is lowered, the cross bar 59 urges the locking arm 60 to pivot to its locking position (FIG. 3B).

When the tray 12 is coupled to the carriage 22, the locking arm 60 is pivoted into its locking position (as urged by the cross bar 59). Thus, the transverse pin 72 of the locking arm 60 is pulled out of the notch 54 in the gauge plate cam 48, which enables the gauge plate cam 48 to be rotated and the position of the gauge plate 32 to be adjusted. Furthermore, when the locking arm 60 is in its locking position, lower portion 61 of the lower arm is located below the lower portion 81 of the retaining bar, which enables the carriage 22 and tray to move along the slicing path A without engaging the end surface 65 of the cross bar 78. Thus, after the tray 12 is mounted onto the carriage 22, the gauge plate 32 may be adjusted to achieve the desired thickness of slices, the slicer 10 may be activated and slicing operations commenced. The carriage 22 and tray 12 then reciprocate along the slicing path A to slice the food product received in the tray 12.

If an interlock mechanism is not desired in the slicer, the assembly of the slicer described herein can be easily modified to produce a slicer lacking an interlock. For example, the locking arm 60, spring 76 and cover 87 may not be mounted onto the slicer if an interlock is not desired. The carriage 20, gauge plate cam 48 and other components need not be changed. Thus, most of the parts in a slicer lacking an interlock are the same as the parts of a slicer having an interlock, which reduces assembly costs.

Having described the invention in detail and by reference to the preferred embodiments, it will be apparent that modifications and variations thereof are possible without departing from the scope of the invention.

What is claimed is:

1. A slicer having an interlock mechanism comprising:

a tray for receiving a food product to be sliced, said tray being movable along a slicing path and having a tray arm;

a blade for slicing said food product as said tray moves along said slicing path;

an adjustable gauge plate for controlling the thickness of the slices of the food product cut by said blade;

a gauge plate adjuster for controlling the position of said gauge plate relative said blade, said gauge plate adjuster having a recess at the periphery thereof; and a carriage having a locking arm for receiving said tray arm, said locking arm being movable between a release position wherein said tray arm can be placed into and removed from said locking arm, and a locking position wherein said tray arm cannot be placed into or removed from said locking arm;

wherein at least part of said locking arm is received in said recess of said gauge plate adjuster when said locking arm is in said release position.

2. The slicer of claim 1 wherein said recess must be aligned with said locking arm in order to allow said part of said locking arm to be received in said recess, and wherein said gauge plate adjuster prevents said locking arm from moving to said release position when said recess is not aligned with said locking arm.

3. The slicer of claim 2 wherein gauge plate adjuster includes a cam that is rotatable about its central axis to control the position of said gauge plate, and wherein said rotation of said cam moves said recess into and out of a position wherein said recess is aligned with said locking arm to receive said part of said locking arm therein.

4. The slicer of claim 3 wherein said gauge plate is in a fully closed position when said recess in said gauge plate adjuster is aligned with said locking arm.

5. The slicer of claim 2 wherein said gauge plate is located in a fully closed position by said gauge plate adjuster when said gauge plate adjuster is aligned to receive said part of said locking arm in said recess.

6. The slicer of claim 5 wherein said carriage is mounted for lateral reciprocation along said slicing path, and wherein said carriage includes a retaining bar that prevents said locking arm from moving to said release position when said carriage is not located in a predetermined position.

7. The slicer of claim 6 wherein said retaining bar extends parallel to said slicing path, and wherein said retaining bar does not block said locking arm from moving to said release position when said carriage is in said predetermined position.

8. The slicer of claim 6 wherein said carriage include a roller that rolls along said retaining bar as said carriage moves along said slicing path.

9. The slicer of claim 6 wherein said predetermined position is a home position.

10. The slicer of claim 6 wherein said locking bar is generally "U" shaped in side view and includes a lower portion that engages said retaining bar when said carriage is not in said predetermined location and said locking bar is attempted to be moved to said release position, and wherein said locking bar includes an upper portion that engages said gauge plate adjuster when said recess is not aligned with said upper portion of said locking bar and said locking bar is attempted to be moved to said release position.

11. The slicer of claim 6 wherein said locking arm and said retaining bar cooperate to prevent the movement of said carriage along said slicing path when said locking arm is in said release position.

12. The slicer of claim 6 wherein said slicer includes a slide rod, and wherein said carriage includes a bushing that fits around said slide rod such that said slide rod guides the reciprocation of said carriage.

13. The slicer of claim 1 wherein said locking arm includes an open end for receiving said tray arm therein, and wherein said tray arm includes a cross bar that can be retained in said open end of said locking arm when said locking arm is in said locking position.

14. The slicer of claim 1 wherein said locking arm is pivotably coupled to said carriage, and wherein said locking arm pivots between said locking position and said release position.

15. The slicer of claim 1 wherein said locking arm is biased in the release position.

16. The slicer of claim 1 wherein said carriage further includes a bolt that extends through said tray arn such that a nut may be threaded onto said bolt to lock said tray arm to said carriage.

17. The slicer of claim 16 wherein said tray includes a slot to receive said bolt such that said tray is located between said nut threaded on said bolt and an upstanding end wall of said carriage, and wherein said locking arm includes a pin that is received in said recess in said gauge plate adjuster when said locking arm is in said release position.

18. The slicer of claim 17 wherein said pin extends generally parallel to said slicing path.

19. The slicer of claim 1 wherein said carriage extends generally below said gauge plate adjuster.

20. The slicer of claim 1 wherein said locking arm prevents said gauge plate adjuster from adjusting the position of said gauge plate when said locking arm is in said release position.

21. The slicer of claim 20 wherein said at least part of said locking arm received in said recess prevents gauge plate adjuster from adjusting the position of said gauge plate when said locking arm is in said release position.

22. A slicer having an interlock mechanism comprising:

a tray for receiving a food product to be sliced, said tray being movable along a slicing path and having a tray arm;

a blade for slicing said food product as said tray moves along said slicing path;

an adjustable gauge plate for controlling the thickness of the slices of the food product cut by said blade;

a gauge plate adjuster for adjusting the position of said gauge plate relative said blade; and a carriage having a locking arm for receiving said tray arm, said locking arm being movable between a release position wherein said tray arm can be placed into and removed from said locking arm, and a locking position wherein said tray arm cannot be placed into or removed from said locking arm, wherein said locking arm prevents said gauge plate adjuster from adjusting the position of said gauge plate when said locking arm is in said release position.

23. A slicer having an interlock mechanism comprising:

a tray for receiving a food product to be sliced, said tray being movable along a slicing path and having a tray arm;

a blade for slicing said food product as said tray moves along said slicing path;

an adjustable gauge plate for controlling the thickness of the slices of the food product cut by said blade, said gauge plate being movable to a fully closed position;

a gauge plate adjuster for adjusting the position of said gauge plate relative said blade; and a carriage having a locking arm for receiving said tray arm, said locking arm being movable between a release position wherein said tray arm can be placed into and removed from said locking arm, and a locking position wherein said tray arm cannot be placed into or removed from said locking arm, wherein said gauge plate adjuster prevents said locking arm from moving to said release position when said gauge plate is not is said fully closed position.

24. The slicer of claim 23 further comprising a retaining bar that prevents said locking arm from moving to said release position when said tray is not in a predetermined position along said slicing path.

* * * * *